US010891917B2

(12) United States Patent
Kuo et al.

(10) Patent No.: US 10,891,917 B2
(45) Date of Patent: Jan. 12, 2021

(54) TRANSPARENT DISPLAY SYSTEM AND OPERATION METHOD THEREOF

(71) Applicants: Industrial Technology Research Institute, Hsinchu (TW); Intellectual Property Innovation Corporation, Hsinchu (TW)

(72) Inventors: Shin-Hong Kuo, New Taipei (TW); Cheng-Chung Lee, Hsinchu (TW); Kuan-Ting Chen, Yunlin County (TW); Yi-Shou Tsai, Taipei (TW); Yu-Hsin Lin, Miaoli County (TW)

(73) Assignees: Industrial Technology Research Institute, Hsinchu (TW); Intellectual Property Innovation Corporation, Hsinchu (TW)

( * ) Notice: Subject to any disclaimer, the term of this patent is extended or adjusted under 35 U.S.C. 154(b) by 28 days.

(21) Appl. No.: 16/205,241

(22) Filed: Nov. 30, 2018

(65) Prior Publication Data

US 2020/0027422 A1 Jan. 23, 2020

(30) Foreign Application Priority Data

Jul. 23, 2018 (TW) ..... 107125360 A

(51) Int. Cl.

| | |
|---|---|
| ***G09G 5/10*** | (2006.01) |
| ***G09G 5/373*** | (2006.01) |
| ***G09G 5/38*** | (2006.01) |

(52) U.S. Cl.

CPC ..... *G09G 5/10* (2013.01); *G09G 5/373* (2013.01); *G09G 5/38* (2013.01);
(Continued)

(58) Field of Classification Search

CPC ..... G09G 5/10; G09G 2320/0626; G09G 2320/066; G09G 2320/0686;
(Continued)

(56) References Cited

U.S. PATENT DOCUMENTS

| | | | |
|---|---|---|---|
| 9,633,478 | B2 | 4/2017 | Kim et al. |
| 2013/0314453 | A1 | 11/2013 | Ko |

(Continued)

FOREIGN PATENT DOCUMENTS

| | | |
|---|---|---|
| CN | 101594427 | 12/2009 |
| TW | I246619 | 1/2006 |

(Continued)

OTHER PUBLICATIONS

"Office Action of Taiwan Counterpart Application", dated Jul. 16, 2019, pp. 1-12.

*Primary Examiner* — Antonio A Caschera
(74) *Attorney, Agent, or Firm* — JCIPRNET

(57) ABSTRACT

A transparent display system including a display panel, a data acquisition module and a computation module is provided. The data acquisition is adapted to capture a field luminance of a field where the display panel is located and a display information luminance of display information of the display panel. The computation module determines whether a luminance contrast of the display information falls within a range from a lower boundary to an upper boundary, wherein the luminance contrast of the display information equals to the field luminance plus the display information luminance and then divided by the field luminance. If it is determined that the luminance contrast of the display information does not fall within the range from the lower boundary to the upper boundary, a luminance contrast optimization procedure is performed. An operation method of the transparent display system is also provided.

15 Claims, 8 Drawing Sheets

(52) U.S. Cl.
CPC ..... *G09G 2320/066* (2013.01); *G09G 2320/0626* (2013.01); *G09G 2320/0686* (2013.01); *G09G 2354/00* (2013.01); *G09G 2360/144* (2013.01); *G09G 2360/145* (2013.01); *G09G 2360/16* (2013.01)

(58) Field of Classification Search
CPC ..... G09G 2360/144; G09G 2360/145; G09G 2360/148
See application file for complete search history.

(56) References Cited

U.S. PATENT DOCUMENTS

| | | | | |
|---|---|---|---|---|
| 2014/0104316 | A1 | 4/2014 | Sharma et al. | |
| 2014/0204023 | A1 | 7/2014 | Kumar et al. | |
| 2016/0351164 | A1 | 12/2016 | Hsieh et al. | |
| 2017/0343809 | A1 | 11/2017 | Benesh et al. | |
| 2019/0025692 | A1* | 1/2019 | Yamashita | G02F 1/13306 |
| 2019/0172419 | A1* | 6/2019 | Hwang | G09G 5/10 |

FOREIGN PATENT DOCUMENTS

| | | |
|---|---|---|
| TW | I267737 | 12/2006 |
| TW | I320497 | 2/2010 |
| TW | I532375 | 5/2016 |
| TW | 201629588 | 8/2016 |
| TW | I576771 | 4/2017 |

* cited by examiner

TRANSPARENT DISPLAY SYSTEM AND OPERATION METHOD THEREOF

CROSS-REFERENCE TO RELATED APPLICATION

This application claims the priority benefit of Taiwan application serial no. 107125360, filed on Jul. 23, 2018. The entirety of the above-mentioned patent application is hereby incorporated by reference herein and made a part of this specification.

BACKGROUND

Technical Field

The disclosure relates to a display system and an operation method thereof, and particularly related to a transparent display system and an operation method thereof.

Description of Related Art

A transparent display itself has a certain degree of transparency. Therefore, while displaying information, the transparent display displays a background behind the transparent display. Based on this transparent property, transparent displays are widely applied to a variety of fields, for example, building windows, car windows, or shop window, etc.

When a background image and display information are both displayed on the transparent display, a luminance contrast of the display information changes along with changes of a background transmissive light luminance of a background image or a display information luminance of the display information. Besides, the background transmissive light luminance of the transparent display changes along with the brightness of the field. For instance, the background transmissive light luminance of the transparent display is lower in a dark field than in a bright field. Therefore, under the condition that the display information luminance remains unchanged, the luminance contrast of the display information may be different because of the changes of the field, and further influences the difficulty of identifying the display information.

SUMMARY

A transparent display system of the disclosure includes a display panel, a data acquisition module, and a computation module. The background behind the display panel is seen through the display panel. The data acquisition module is adapted to capture a field luminance of a field where the display panel is located and a display information luminance of the display information of the display panel, wherein the field luminance includes a foreground reflective light luminance and a background transmissive light luminance. The computation module is coupled to the display panel and the data acquisition module. The computation module determines whether a luminance contrast of the display information falls within a range from a lower boundary to an upper boundary based on the captured field luminance and the display information luminance, wherein the luminance contrast of the display information equals to the field luminance plus the display information luminance and then divided by the field luminance. If the luminance contrast of the display information is determined not falling within the range from the lower boundary to the upper boundary, a luminance contrast optimization procedure is performed.

An operation method of a transparent display system of the disclosure includes steps as follow: capturing a field luminance and a display information luminance of display information, wherein the field luminance comprises a foreground reflective light luminance and a background transmissive light luminance; determining whether a luminance contrast of the display information falls within a range from a lower boundary to an upper boundary, wherein the luminance contrast of the display information equals to the field luminance plus the display information luminance and then divided by the field luminance; if the luminance contrast of the display information is determined falling within the range from the lower boundary to the upper boundary, the display information being output; and if the luminance contrast of the display information is determined not falling within the range from the lower boundary to the upper boundary, a luminance contrast optimization procedure being performed.

An operation method of a transparent display system of the disclosure includes steps as follow: capturing a field luminance and a display information luminance of a display information, wherein the field luminance comprises a foreground reflective light luminance and a background transmissive light luminance; determining whether a luminance contrast of the display information may be recognized by a human eye, wherein the luminance contrast of the display information equals to the field luminance plus the display information luminance and then divided by the field luminance; if the luminance contrast of the display information is determined being recognized by the human eye, the display information is output; and if the luminance contrast of the display information is determined not being recognized by the human eye, the display information luminance is optimized, a display information size is optimized, a location of the display information is changed, or the field luminance is optimized.

To make the aforementioned more comprehensible, several exemplary embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EXEMPLARY EMBODIMENTS

Figure 1:
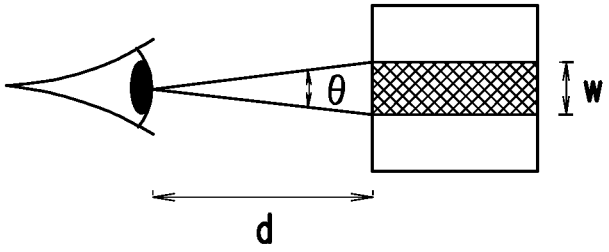
FIG. 1 is a schematic view explaining the minimum spatial resolution distinguished by a human eye.

FIG. 1 is a schematic view explaining the minimum spatial resolution distinguished by a human eye. Generally, when a luminance contrast is 1, the minimum spatial resolution that can be clearly distinguished by a human eye is 1/60 degrees. In FIG. 1, θ is a viewing angle, w is a size of display information (e.g. a width of the strip in FIG. 1), and d is a distance between a user and the display information. According to FIG. 1, Formula 1 is inferred. The minimum spatial resolution that can be clearly distinguished by the human eye is θ=1/60 degrees. That is, if θ is smaller than 1/60 degrees, the display information is difficult to be clearly distinguished.

$$\theta = \tan^{-1}\left(\frac{w}{d}\right) \qquad \text{Formula 1}$$

The study has found that the decrease in the luminance contrast of the display information leads to an increase of the minimum spatial resolution that can be clearly distinguished by the human eye. That is, the minimum spatial resolution that can be clearly distinguished by the human eye is negatively related to the luminance contrast of the display information, and the decrease in the luminance contrast of the display information leads to the decrease in the visibility of the human eye.

The luminance contrast of the display information equals to a field luminance plus a display information luminance and then divided by the field luminance. That is, if C is illustrated as the luminance contrast of the display information, A is illustrated as the field luminance, and B is illustrated as the display information luminance, the relationship of the luminance contrast of the display information, the field luminance, and the display information luminance is C=(A+B)/A.

Figure 2A:
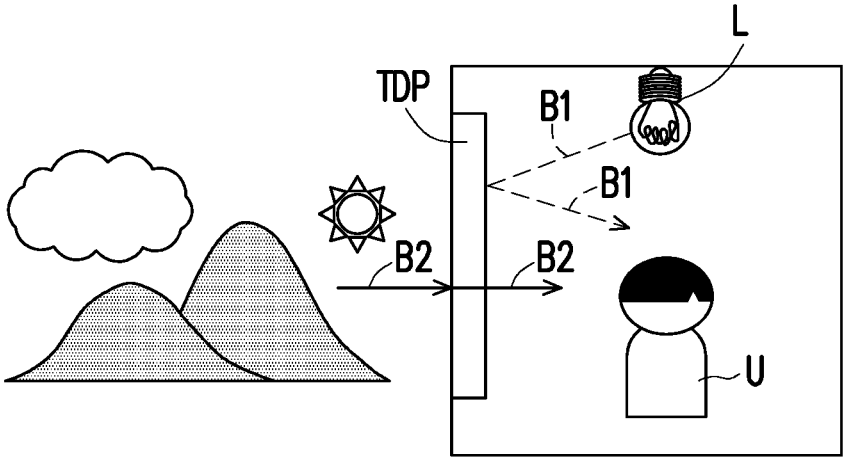
FIG. 2A is a schematic view of a field applied with a transparent display.
Figure 2B:
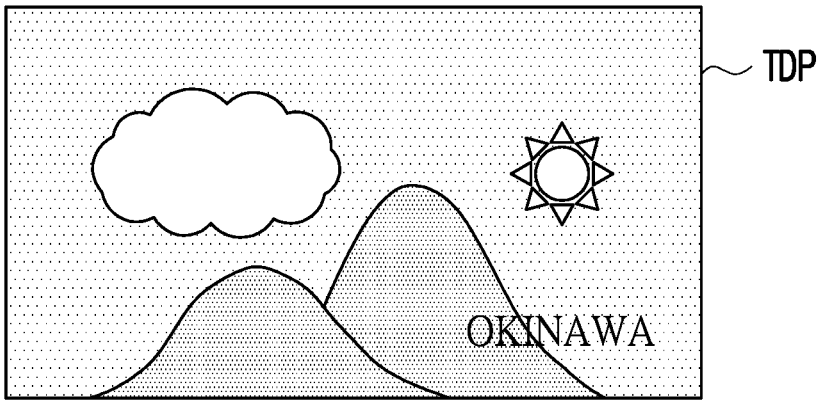
FIG. 2B is a schematic view of screen displayed by the transparent display displayed in FIG. 2A.

The field luminance and the display information luminance are explained along with FIG. 2A and FIG. 2B. FIG. 2A is a schematic view of a field applied with a transparent display. FIG. 2B is a schematic view of screen displayed by the transparent display displayed in FIG. 2A.

In FIG. 2A and FIG. 2B, a transparent display TDP is used as a building window. With the transparent property of the transparent display TDP, a user U stands indoors of a building can see the display information (e.g. characters "OKINAWA") on the transparent display TDP and a background image (e.g. mountains, clouds, and the sun) at the same time. In other words, the user U can see the background behind the transparent display TDP through the transparent display TDP.

The display information luminance is the luminance of the display information (e.g. the characters "OKINAWA"). The field luminance includes the foreground reflective light luminance and the background transmissive light luminance. The foreground reflective light luminance is a luminance of a foreground beam reflected by the transparent display, and the background transmissive light luminance is a luminance of a background beam penetrating the transparent display. In FIG. 2A, an indoor lighting L emits a beam B1, and the luminance of the beam B1 reflected by the transparent display TDP is the foreground reflective light luminance. For example, the foreground reflective light luminance may be detected by a light detecting device, such as a photodetector, a colorimeter, a luminance meter, a spectrometer, or an image capturing device. Furthermore, the luminance of the indoor lighting is captured by the light detecting device, and the luminance of the beam B1 reflected by the transparent display TDP is then calculated by a computation module. Alternatively, the luminance of the beam B1 reflected by the transparent display TDP is directly captured by the light detecting device.

A beam B2 from the background behind the transparent display TDP enters the building through the transparent display TDP, and the background image is displayed on the transparent display TDP. The luminance of the beam B2 output by the background image of the transparent display TDP is the aforementioned background transmissive light luminance. For example, the background transmissive light luminance can be acquired by using the aforementioned light detecting device to capture the background image displayed on the transparent display TDP from the user U side. Alternatively, the background transmissive light luminance can be acquired by using the aforementioned light capturing device to capture the background outdoors and then using the computation of the computation module (e.g. multiplying the luminance information captured by the aforementioned light detecting device by the transmittance of the transparent display TDP). In an embodiment, the background image on the transparent display TDP can also be captured by the image capture device, and a target image to be introduced is then searched from the background image captured by the image capturing device by a target scene recognition technology. Afterwards, the luminance information is extracted from a display block where the display information is to be displayed. In other words, the background transmissive light luminance of the whole transparent display TDP may be captured, or only the background transmissive light luminance of the display block where the display information is to be displayed may be captured.

The luminance contrast of the display information is affected by the display information luminance, the foreground reflective light luminance and the background transmissive light luminance. Therefore, even if size, color, location, and other parameters alike of the display information (e.g. the characters of "OKINAWA") and the foreground reflective light luminance remain unchanged, the luminance contrast of the display information will still vary as the background transmissive light luminance changes with the brightness changes of the field, and the recognition difficulty of the display information is further affected.

To enable the user U to clearly see the display information, the disclosure proposes a transparent display system that can increase visibility of display information by a luminance contrast optimization procedure when a luminance contrast of the display information is determined not easy to be recognized by the human eye. In addition, the disclosure further proposes an operation method of the transparent display system, which is capable of determining whether the luminance contrast optimization procedure is required to be performed to increase the visibility of the display information.

Figure 3:
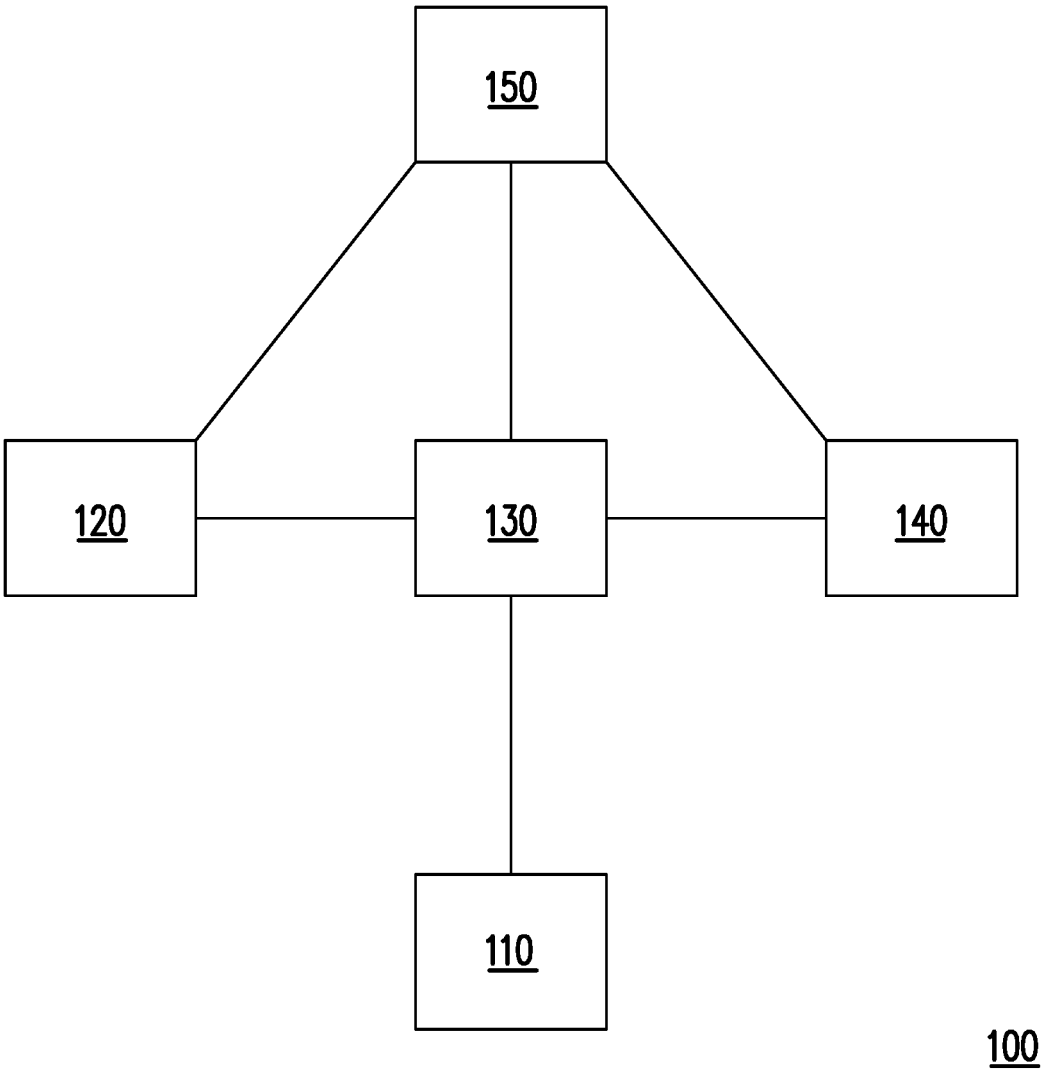
FIG. 3 is a schematic view of a transparent display system according to an embodiment of the disclosure.

FIG. 3 is a schematic view of a transparent display system according to an embodiment of the disclosure. Please refer to FIG. 3, a transparent display system 100 includes a display panel 110, a data acquisition module 120, and a computation module 130.

The display panel 110 enables the user to see the background behind the display panel 110 through the display panel 110. For instance, the display panel 110 may be a transmissive display panel (transparent display panel, TDP) as illustrated in FIG. 2A. However, the field to which the transmissive display panel is applied is not limited to the one shown in FIG. 2. In addition to being used as the building window, the transmissive display panel may be used as a car window, a shop window, or any object that requires both light transmission and display functions.

Figure 4:
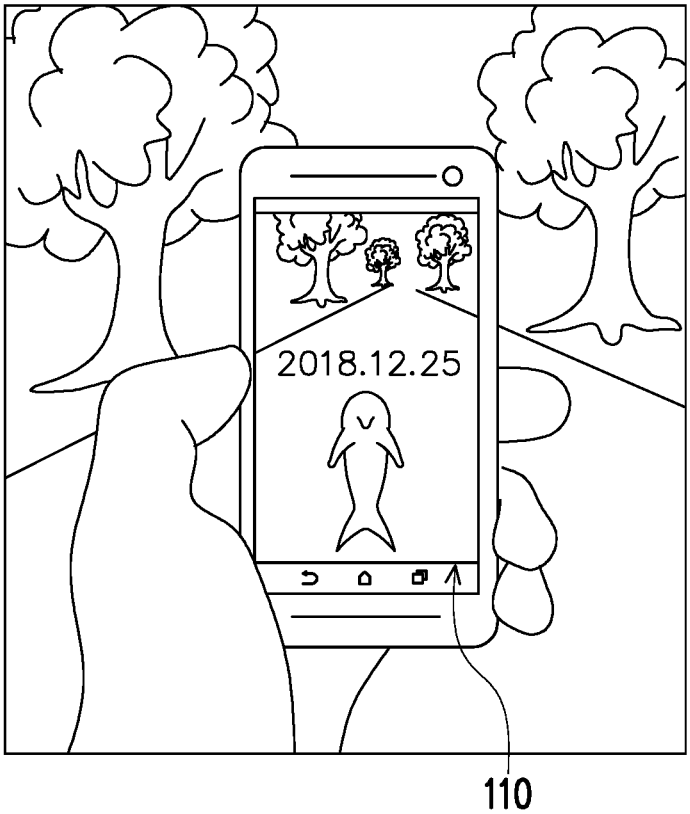
FIG. 4 is a schematic view of an electronic device applied to the transparent display system of FIG. 3.

FIG. 4 is a schematic view of an electronic device applied to the transparent display system of FIG. 3. As illustrated in FIG. 4, the display panel 110 of the transparent display system 100 may also be a non-transmissive display panel, such as a traditional liquid crystal display panel. However, the disclosure is not limited thereto. The non-transmissive display panel captures the background behind the non-transmissive display panel through a rear lens module (not illustrated), and thus enables the user to see the background behind the display panel 110.

Please refer to FIG. 3, the data acquisition module 120 is adapted to capture the field luminance of the field where the display panel 110 is located and the display information luminance of the display panel 110. For instance, the data acquisition module 120 includes the aforementioned light detecting device. Based on needs, the data acquisition module 120 may further capture at least one of the user information, such as identity, location, line of sight range of the user, gaze position, and user preference. For example, the data acquisition module 120 may further include a light field camera, a rangefinder, and devices alike to acquire the aforementioned user information.

The user preference in the user information may include gender, age, disease, or habits (e.g. viewing preference or usage preference), etc. The information of the user's gender, age, information regarding eyes (such as whether the user has vision correction, eye trauma, bleeding in eye, and so on), or habits (e.g. viewing preference or usage preference), etc. is determined by the image capturing device. Alternatively, the transparent display system 100 may further include an input device to allow the user to input his or her user preference. Moreover, the transparent display system 100 may further include a data storage module to store the user preferences. When the user enters into a working range of the transparent display system 100 or the user uses the display panel, the user preference is acquired by the image capturing device confirming the user identity (e.g. facial recognition), and then searching a database in the data storage module.

The computation module 130 is coupled to the display panel 110 and the data acquisition module 120 for signal transmission. The coupling includes a wired and a wireless connection. The computation module 130 is adapted to receive the field luminance and the display information luminance that are captured by the data acquisition module 120, and the computation module 130 is adapted to determine whether the luminance contrast is recognized by the human eye based on the captured field luminance and the display information luminance. For example, the computation module 130 may include a central performing unit (CPU) or a graphical performing unit (GPU). However, the disclosure is not limited thereto.

The luminance contrast of the display information clearly recognized by the human eye is determined by a lower boundary and an upper boundary of the luminance contrast. In this embodiment, the lower boundary of the luminance contrast is defined by the Formula 1 and the Formula 2, and the upper boundary of the luminance contrast is defined by the Formula 1, the Formula 3 and the Formula 4. Please refer to the aforementioned descriptions regarding Formula 1, and the descriptions will not be repeated here. In Formula 3, k falls within a range from 8.4 to 30.8, and LB is the background transmissive light luminance.

$$1.773\times e^{-\left(\frac{\theta-13.95}{22.95}\right)^2}+1.234\times e^{-\left(\frac{\theta+0.2208}{0.4677}\right)^2} \quad \text{Formula 2}$$

$$\frac{f(d)\times k}{LB^{0.5}\times\tan\theta} \quad \text{Formula 3}$$

$$f(d)=-0.1734\times d^3+0.6648\times d^2+0.6372\times d+0.9788 \quad \text{Formula 4}$$

Figure 5:
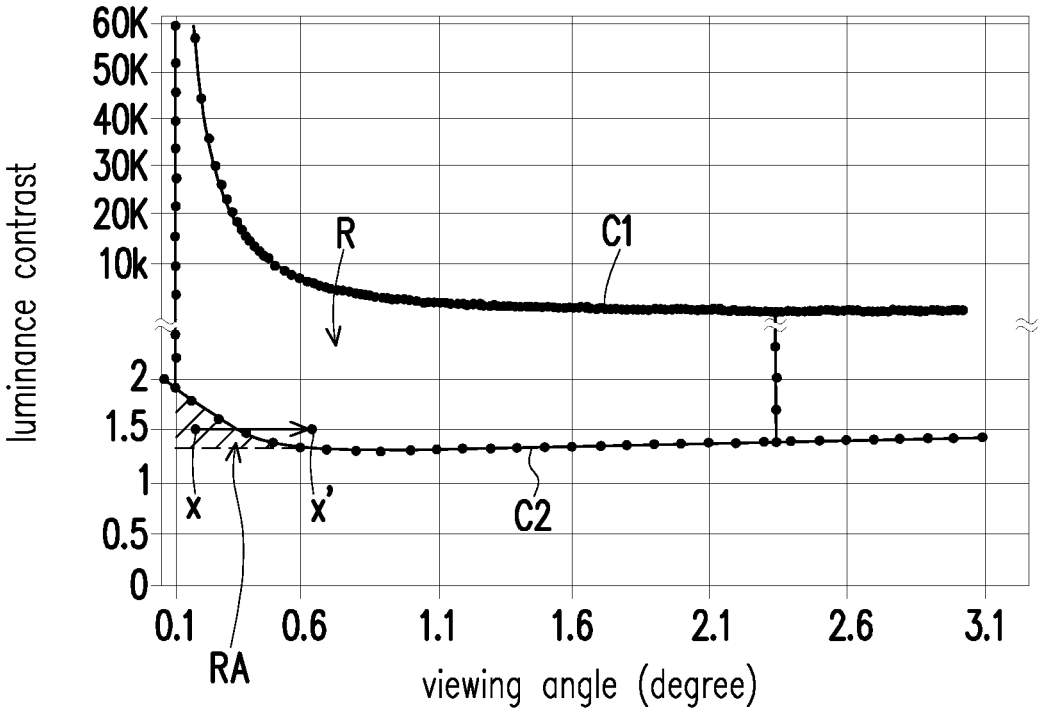
FIG. 5 is a relation diagram of a viewing angle and a luminance contrast.

FIG. 5 is a relation diagram of a viewing angle and a luminance contrast. Please refer to FIG. 5, a curve C1 and a curve C2 are drawn based on $$1.773\times e^{-\left(\frac{\theta-13.95}{22.95}\right)^2}+1.234\times e^{-\left(\frac{\theta+0.2208}{0.4677}\right)^2}\leq \text{luminance contrast and luminance contrast}\leq\frac{f(d)\times k}{LB^{0.5}\times\tan\theta}\ \text{respectively.}$$

The curve C1 represents the comfort limit of the human eye recognition, whereas the curve C2 represents the limit of human eye recognition. When the luminance contrast of the display information falls between the curve C1 and the curve C2, the display information can be clearly recognized by the human eye. When the luminance contrast of the display information falls above the curve C1, the user feels uncomfortable when the human eye recognizes the display information because the luminance contrast is too high. When the luminance contrast of the display information falls below the curve C2, the human eye is likely to fail to clearly recognize the display information because the luminance contrast is too low.

Besides, the viewing angle is limited by the reading limit of the human eye. Generally, the reading limit of the human eye falls within the range between 0.15 degrees to 2.25 degrees of the viewing angle. When the display information size of the display information fails to fall within the range between 0.15 degrees to 2.25 degrees of the viewing angle (e.g. the viewing angle is smaller than 0.15 degrees or greater than 2.25 degrees), the display information is not easy to be recognized. Combined with the Formula 1 to Formula 4 and the aforementioned viewing angle range, a human eye identifiable range R shown in FIG. 5 is framed.

Please refer to FIG. 3 and FIG. 4. The computation module 130 determines whether the luminance contrast of the display information falls within the range from the lower boundary to the upper boundary. If the computation module 130 determines the luminance contrast of the display information fails to fall within the range from the lower boundary to the upper boundary, representing that the luminance contrast of display information falls into the region difficult to be recognized, the luminance contrast optimization procedure is performed to increase the visibility of the display information. The luminance contrast optimization procedure includes at least one of optimizing a display information luminance, optimizing the display information size, changing the location of the display information displayed on the display panel 110, and optimizing the field luminance. The aforementioned optimization procedure will be illustrated later. Moreover, the computation module 130 further determines whether the display information size of the display information falls within the range between 0.15 degrees to 2.25 degrees of the viewing angle. If the display information size of the display information is determined not falling within the range between 0.15 degrees to 2.25 degrees of the viewing angle, the display information size of the display information is optimized, so that the luminance contrast of the display information falls within the range of the reading limit of the human eye.

When the luminance contrast of the display information falls within the human eye identifiable range R as illustrated in FIG. 5, the luminance contrast may be further optimized (e.g. at least one of optimizing the display information luminance, optimizing the display information size, and optimizing the field luminance), to increase the visibility of the display information.

Based on different needs, the transparent display system 100 may further selectively include other elements, devices or modules. For instance, the transparent display system 100 may further include an input device 140 and a data storage module 150. The computation module 130 is further coupled to the input device 140 to receive the user preference input by the user. The computation module 130 adjusts the threshold value range of the luminance contrast of the display information based on the user preference input by the user (e.g. reducing or expanding the human eye identifiable range R as illustrated in FIG. 5). Besides, the data storage module 150 is coupled to the data acquisition module 120, the computation module 130 and the input device 140 to store the user information captured by the data acquisition module 120, the program for determining the luminance contrast, and the user preference input by the user, etc.

Figure 6:
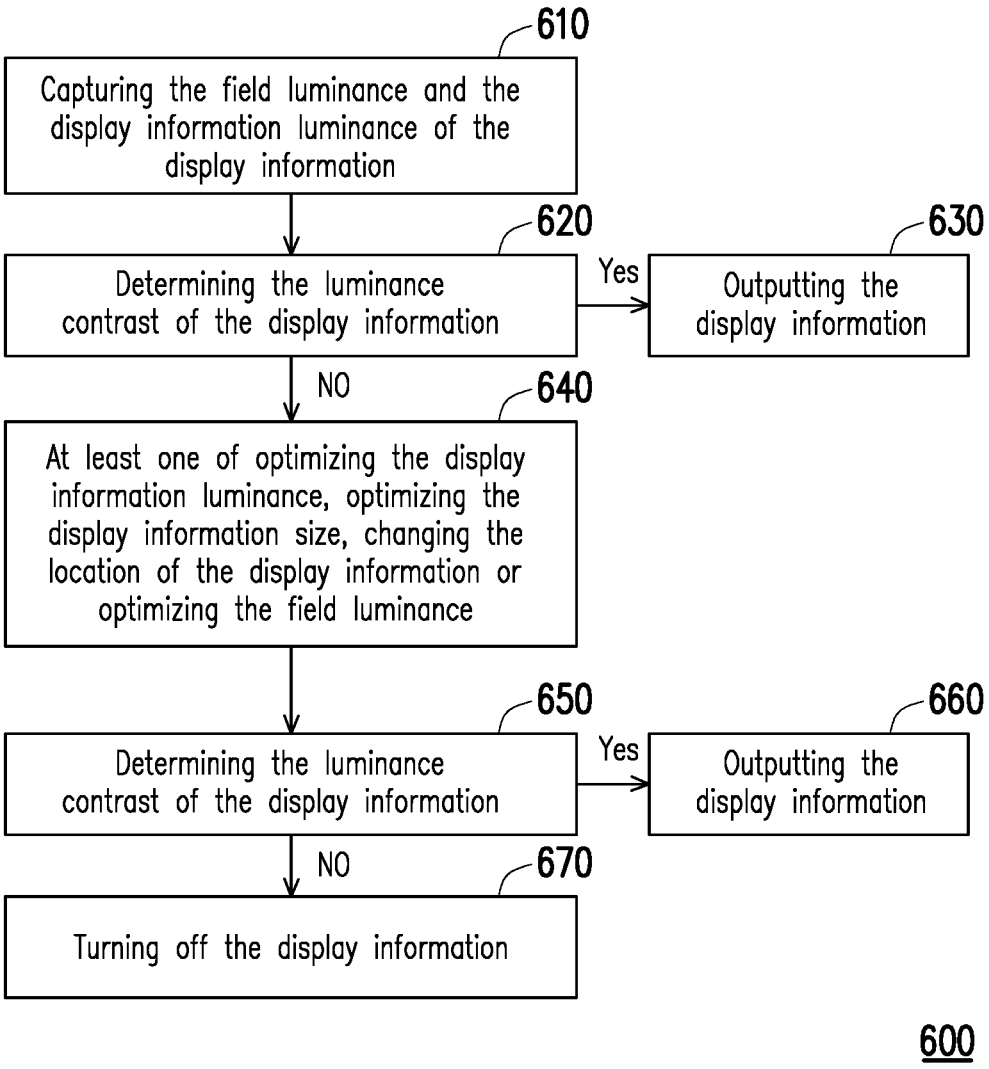
FIG. 6 is a flow chart of an operation method of a transparent display system according to an embodiment of the disclosure.

FIG. 6 is a flow chart of an operation method of a transparent display system according to an embodiment of the disclosure. Please refer to FIG. 6. An operation method 600 of the transparent display system includes the following steps. Firstly, capture the field luminance and the display information luminance of the display information (Step 610). In this step, the user information (e.g. at least one of the user's identity, location, line of sight range of the user, gaze position, and user preference) can be captured as well.

Then, the luminance contrast of the display information is determined (Step 620). In this step, the computation module determines whether the luminance contrast of the display information can be recognized by the human eye. For example, whether the luminance contrast of the display info illation can be recognized by the human eye is determined based on whether the luminance contrast of the display information falls within the range from the lower boundary to the upper boundary.

If it is determined that the luminance contrast of the displayed information can be recognized by the human eye, for example, if it is determined that the luminance contrast of the display information falls within the range from the lower boundary to the upper boundary, the display information is output (Step 630). Alternatively, as mentioned above, the luminance contrast of the display information may be further optimized in the human eye identifiable range R as shown in FIG. 5, and then the optimized display information is output.

On the other hand, if it is determined that the luminance contrast of the displayed information cannot be recognized by the human eye, for example, if it is determined that the luminance contrast of the display information does not fall within the range from the lower boundary to the upper boundary, the luminance contrast optimization procedure is performed, for example, optimizing the display information luminance, optimizing the display information size, changing the location of the display information or optimizing the field luminance (Step 640).

FIG. 7A to FIG. 7G are comparison views of differences between a display image of a display panel of the transparent display system in FIG. 2A before and after performing luminance contrast optimization procedure respectively. In FIG. 7A to FIG. 7G, the left side of an arrow is a display image not processed by the luminance contrast optimization procedure, while the right side of the arrow is a display image processed by the luminance contrast optimization procedure. In addition, in FIG. 7B to FIG. 7F, a region RO is the optimized region.

According to FIG. 5, if the luminance contrast of the display information is determined not falling within the range from the lower boundary to the upper boundary (e.g. not falling within the human eye identifiable range R as illustrated in FIG. 5), the luminance contrast of the display information may be too low or too high.

The low luminance contrast of the display information may be resulted from a variety of conditions, for example, the projection location of an indoor lighting overlapping with the location of the display information on the display panel, the background image being too bright (e.g. sunrise, sunset, or noon), high luminance illumination in the background image (e.g. a street light, a car light or an advertising board) overlapping with the display information or the display information influenced by sunlight reflection (e.g. water reflection, snow reflection, building window reflection, or car window reflection, and so on).

When the luminance contrast of the display information is too low, the first method for making the luminance contrast of the display information fall into the human eye identifiable range R as illustrated in FIG. 5 is to optimize the display information luminance. For example, optimizing the display information luminance can be increase in the display information luminance. The increase in the display information luminance may indicate the increase in a whole or partial of the luminance in the display information. For example, change the luminance of all the characters of "OKINAWA", or merely change part of the luminance of characters of "OKINAWA" (NAWA) of FIG. 2B.

Figure 7A:
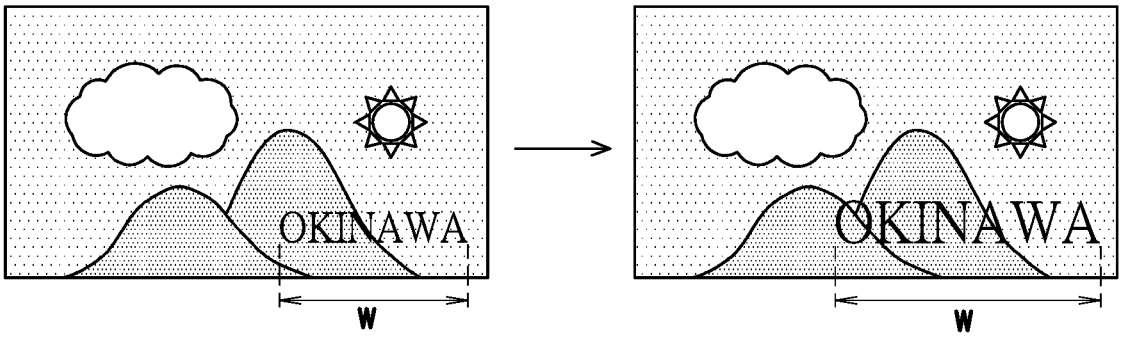
FIG. 7A to FIG. 7G are comparison views of differences between a display image of a display panel of the transparent display system in FIG. 2A before and after performing a luminance contrast optimization procedure respectively.

When the luminance contrast of the display information is too low, the second method for making the luminance contrast of the display information fall into the human eye identifiable range R as illustrated in FIG. 5 is to optimize the display information size. Please refer to FIG. 5. If the luminance contrast of the display information is lower than the lower boundary (please refer to the curve C2) and the viewing angle falls within the range between 0.15 degrees to 0.6 degrees (please refer to a slash region RA in the lower left corner of the human eye identifiable range R), the luminance contrast optimization procedure includes increasing the display information size. For example, the coordinate X originally falling in the slash region RA may be moved right to the coordinate X' in the human eye identifiable range R. According to the Formula 1, the viewing angle is related to the width of the display information (e.g. characters "OKINAWA") and the distance between the user and the display information. Under the condition that the distance between the user and the display information is fixed, that is, under the condition that the locations of the user and the display information remain unchanged, optimizing the display information size may be enlarging the display information. As illustrated in FIG. 7A, the viewing angle increases along with the increase of the width w of the display information.

When the luminance contrast of the display information is too low, the third method for making the luminance contrast of the display information fall into the human eye identifiable range R as illustrated in FIG. 5 is to optimize the field luminance. Optimizing a field luminance includes optimizing the foreground reflective light luminance and optimizing the background transmissive light luminance.

When the low luminance contrast of the display information is resulted from the foreground reflective light luminance (e.g. the projection location of the indoor lighting overlapping with the location of the display information on the display panel), the visibility of the display information is increased by changing the foreground reflective light luminance. For example, lower the luminance of the indoor lighting or change the projection location of the indoor lighting, and so on.

Figure 7B:
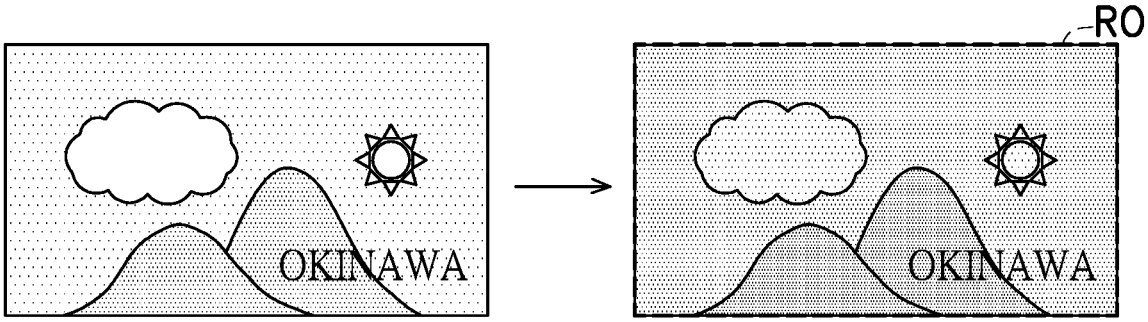
Figure 7C:
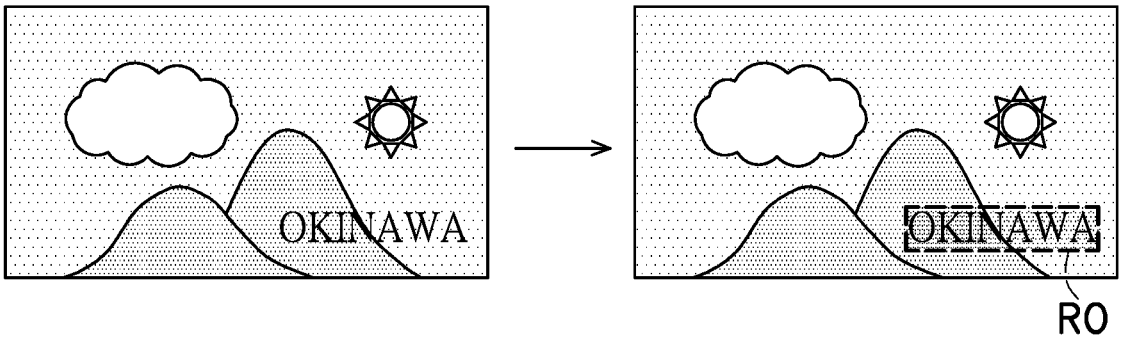
Figure 7D:
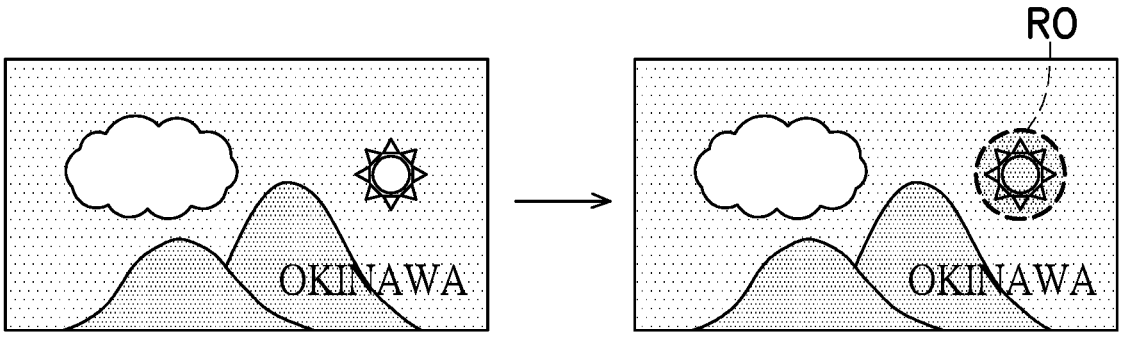

When the low luminance contrast of the display information is resulted from the background transmissive light luminance (e.g. the background image being too bright or the high luminance lighting of the background image overlapping with the display information), the background transmissive light luminance is optimized by shielding the whole region or partial region of the background image. For example, if the background transmissive light luminance is twice greater than the display information luminance, optimizing the field luminance includes shielding the whole region or partial region of the background image. As illustrated in FIG. 7B, the region RO after performing optimization totally overlaps the background image (e.g. mountains, clouds, and the sun), and the luminance of the background image after performing optimization (the luminance of the region RO) is lower than the luminance of the background image before performing optimization. As illustrated in FIG. 7C, the region RO overlaps the display information (e.g. the characters "OKINAWA"), to increase the visibility of the display information. In addition, if the luminance contrast of the background image (i.e. the luminance of the brightest pixel in the background image divided by the luminance of the darkest pixel in the background image) is greater than 600, optimizing the field luminance includes shielding the high luminance region in the background image. As illustrated in FIG. 7D, the region RO overlaps the displayed region of the sun.

The method of the aforementioned shielding background image is by changing a voltage supplied to electrochromic materials in the display panel, so as to change colors or transparency of the electrochromic materials, and thus achieve the effect of shielding the whole region or partial region of the background image. Alternatively, the effect of shielding the whole region or partial region of the background image may also be achieved by changing a gray scale value in the pixel of the region RO. In FIG. 7B to FIG. 7D, the shielding background image is illustrated by changing the luminance of the background image. After changing the luminance of the background image (i.e. the luminance in the region RO), the scenery in the region RO is still visible (e.g. the scenery in the region RO being seen as illustrated in FIG. 7B to FIG. 7D) or invisible (i.e. black image).

The high luminance contrast of the display information may be resulted from the foreground reflective light luminance far lower than the background transmissive light luminance, for example, the display box in the dim exhibition hall illuminated by strong light, watching night scene in the building configured the transparent display, a transportation vehicle having the transparent display entering a tunnel or in an underwater tunnel inside an aquarium having the transparent display.

When the luminance contrast of the display information is too high, the first method for making the luminance contrast of the display information fall into the human eye identifiable range R as illustrated in FIG. 5 is to optimize the display information luminance. For example, optimizing the display information luminance can be decrease in the display information luminance. The decrease in the display information luminance may indicate the decrease in a whole or partial of the luminance in the display information.

When the luminance contrast of the display information is too high, the second method for making the luminance contrast of the display information fall into the human eye identifiable range R as illustrated in FIG. 5 is to optimize the display information size. For example, the optimization of the display information size may indicate reducing the display information size (e.g. decreasing the width of the display information).

Figure 7E:
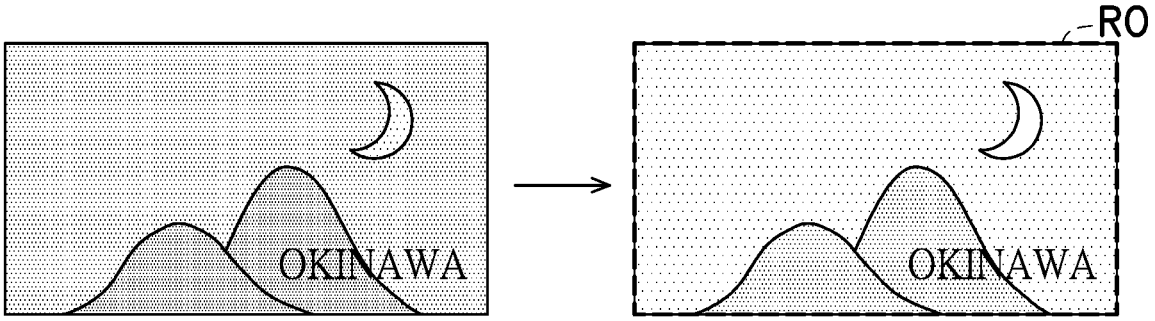
Figure 7F:
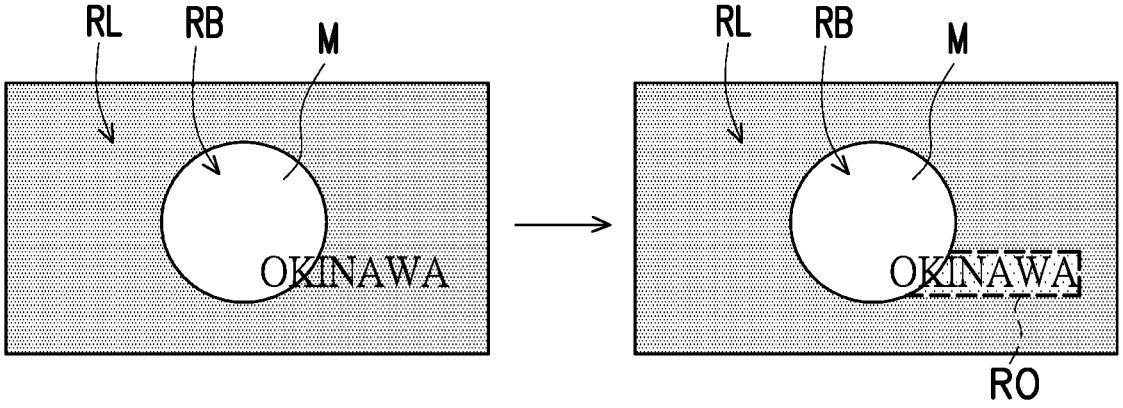

When the luminance contrast of the display information is too high, the third method for making the luminance contrast of the display information fall into the human eye identifiable range R as illustrated in FIG. 5 is to optimize the field luminance. Optimizing the field luminance includes optimizing the foreground reflective light luminance or optimizing the background transmissive light luminance. Optimizing the foreground reflective light luminance can be increase in the foreground reflective light luminance, so as to increase the visibility of the display information. Optimizing the background transmissive light luminance may include enhancing the luminance of the whole region of the background image or the luminance of the low luminance region in the background image. For example, if the field luminance (e.g. the background transmissive light luminance) is lower than the default value, optimizing the field luminance includes enhancing the luminance of the whole region of the display panel. The default value is set based on needs. For example, the default value may be 20 nits. However, the disclosure is not limited thereto. As illustrated in FIG. 7E, the region RO after performing optimization totally overlaps the background image (e.g. mountains, clouds, and the sun), and the luminance (i.e. the luminance in the region RO) of the background image after performing optimization is higher than the luminance of the background image before performing optimization. Furthermore, if the display information traverses the boundary between a high luminance region and the low luminance region of the background image, optimizing the field luminance includes enhancing the luminance of the low luminance region in the background image, so that the display information is suitable for reading. As illustrated in FIG. 7F, the region where a moon M is located in the background image is a high luminance region RB, and other regions in the background image are low luminance regions RL. The display information (e.g. characters "OKINAWA") traverses the high luminance region RB and the luminance region RL. Therefore, the region RO after performing optimization overlaps the area to be displayed of the display information in the low luminance region RL to increase the visibility of the display information.

Figure 7G:
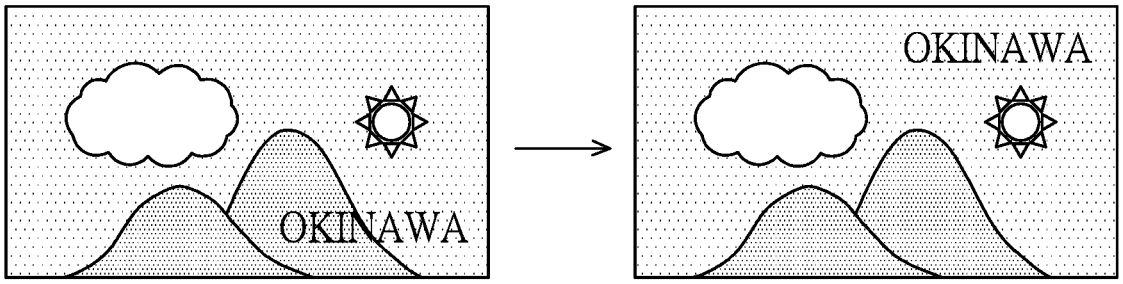

Moreover, when the luminance contrast of the display information is too low or too high, or when the luminance contrast of the display information fails to effectively fall into the human eye identifiable range R as illustrated in FIG. 5 by optimizing the display information luminance, optimizing the display information size and optimizing the field luminance, the visibility of the display information can be increased by changing the location of the display information, as illustrated in FIG. 7G.

Please further refer to FIG. 6. After optimizing the luminance contrast of the display information, whether the luminance contrast of the display information can be recognized by the human eye is determined once again (Step 650). If it is determined that the luminance contrast of the displayed information can be recognized by the human eye, the display information is output (Step 660). On the other hand, if it is determined that the luminance contrast of the displayed information cannot be recognized by the human eye, the display information is turned off (Step 670). For example, if it is confirmed that optimizing the display information luminance, optimizing the display information size, changing the location of the display information and optimizing the field luminance cannot make the luminance contrast of the displayed information fall within the human eye identifiable range R as illustrated in FIG. 5, the display information is turned off.

It should be illustrated that the visibility of the display information may vary along with changes such as gender, age, disease, or habits. Therefore, in another embodiment, after Step 610 and before Step 620, the operation method of the transparent display system further includes capturing the user information and adjusting the threshold value range of the luminance contrast of the display information based on the user information. As such, the visibility of the display information is increased more efficiently and precisely.

Figure 8:
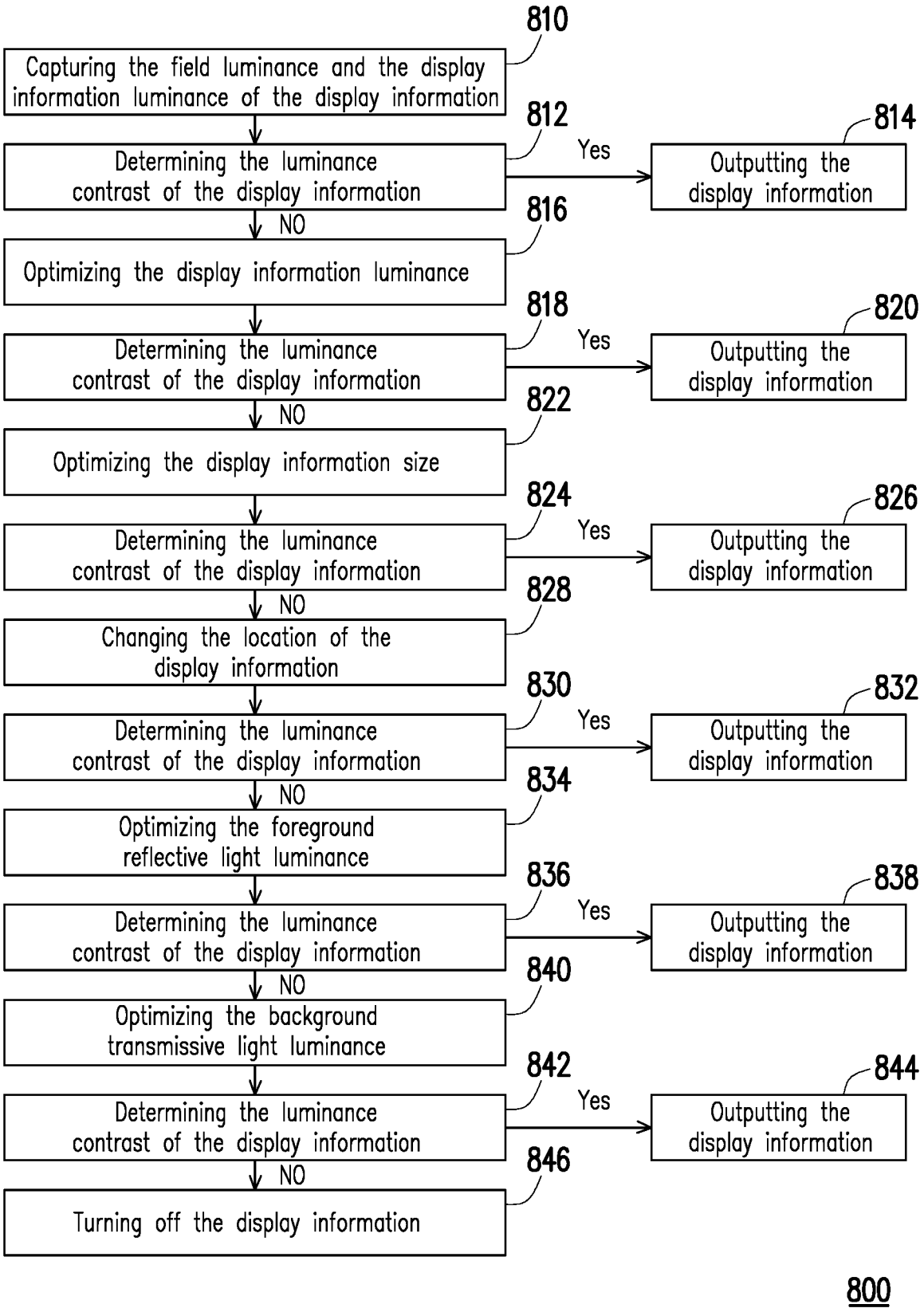
FIG. 8 and FIG. 9 are flow charts of an operation method of a transparent display system according to other embodiments of the disclosure.
Figure 9:
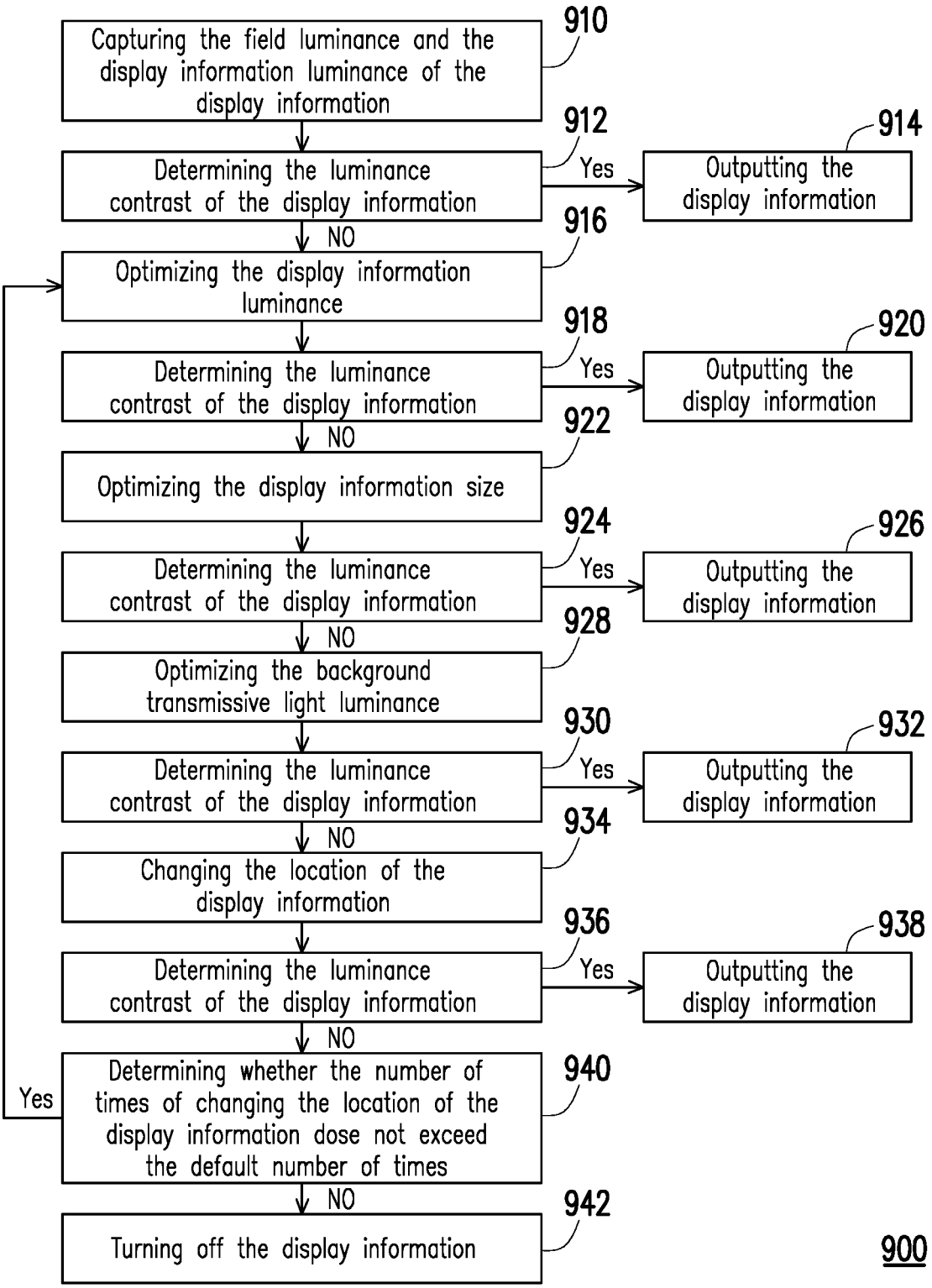

FIG. 8 and FIG. 9 are flow charts of an operation method of a transparent display system according to other embodiments of the disclosure.

Please refer to FIG. 8. An operation method 800 of the transparent display system of the embodiment is similar to the operation method 600 of the transparent display system illustrated in FIG. 6. The main differences between the two operation methods of the transparent display system are as below. In the operation method 800 of the transparent display system, the aforementioned plurality of optimizing procedures (e.g. optimizing the display information luminance, optimizing the display information size, changing the location of the display information, optimizing the foreground reflective light luminance, and optimizing background transmissive light luminance) are executed in order, and the step of determining the luminance contrast of the display information is performed after each of the optimization procedures. If the display information still fails to be clearly recognized, another optimization procedure is thus followed. Please refer to Step 810 to Step 846 for the execution order of the aforementioned plurality of optimization procedures, and please refer to the above for the detailed illustrations of the aforementioned plurality of optimization procedures, and it is not repeated thereto.

It should be illustrated that the execution order of the aforementioned plurality of optimization procedures may be changed based on needs, and is not limited to those illustrated in FIG. 8. For instance, the order of Step 826 (changing the location of the display information) and Step 834 (optimizing the foreground reflective light luminance) may be reversed.

Please refer to FIG. 9. An operation method 900 of the transparent display system of the embodiment is similar to the operation method 800 of the transparent display system illustrated in FIG. 8. The main differences between the two operation methods of the transparent display system are as below. In the operation method 900, the step of optimizing the foreground reflective light luminance in FIG. 8 is omitted. Specifically, the operation method 900 of the transparent display system is applied to the cases that the foreground reflective light luminance is not suitable for adjustment, difficult to adjust, or unable to adjust.

After Step 922 of optimizing the display information size, if the display information is still determined not being clearly recognized in Step 924, which determines the luminance contrast of the display information, Step 928, which optimizes the background transmissive light luminance, is followed. After Step 928, which optimizes the background transmissive light luminance, if the display information is still determined not being clearly recognized in Step 930, which determines the luminance contrast of the display information, Step 934, which changes the location of the display information is followed. After Step 934, which changes the location of the display information, if the display information still fails to be clearly recognized in Step 936, which determines the luminance contrast of the display information not being recognized, whether the number of times of changing the location of the display information does not exceed the default number of times is determined (Step 940) subsequently. If it is determined that the number of times of changing the location of the display information does not exceed the default number of times, Step 916 is returned. On the other hand, if it is determined that the number of times of changing the location of the display information exceeds the default number of times, the display information is turned off (Step 942). The default number of times may be designed according to actual needs.

In summary of the above, in the operation method of the transparent display system and the transparent display system of the disclosure, whether the luminance contrast of the display info illation can be recognized by the human eye may be determined by the computation module. When the luminance contrast of the display information is determined not easy to be recognized by the human eye, the luminance contrast optimization procedure is performed. Therefore, the transparent display system and the operation method of the transparent display system of the disclosure are able to increase the visibility of the display information, and the transparent display system and the operation method of the transparent display system of the disclosure are applicable to different fields.

Although the disclosure is disclosed as the exemplary embodiments above, the exemplary embodiments are not meant to limit the disclosure. Any person skilled in the art may make slight modifications and variations without departing from the spirit and scope of the disclosure. Therefore, the protection scope of the disclosure shall be defined by the claims attached below.

What is claimed is:

1. A transparent display system, comprising:

a display panel, from which a background located behind the display panel is seen;

a data acquisition module, adapted to capture a field luminance of a field where the display panel is located and a display information luminance of display information of the display panel, wherein the field luminance comprises a foreground reflective light luminance and a background transmissive light luminance; and a computation module, coupled to the display panel and the data acquisition module, the computation module determining whether a luminance contrast of the display information falls within a range from a lower boundary to an upper boundary based on the captured field luminance and the display information luminance, wherein the luminance contrast of the display information equals to the field luminance plus the display information luminance and then divided by the field luminance, if the luminance contrast of the display information is determined not falling within the range from the lower boundary to the upper boundary, a luminance contrast optimization procedure is performed; and if the luminance contrast of the display information is determined falling within the range from the lower boundary to the upper boundary, the display information being output.

2. The transparent display system according to claim 1, wherein the lower boundary is defined by Formula 1 and Formula 2, and the upper boundary is defined by Formula 1, Formula 3, and Formula 4, $$\theta = \tan^{-1}\left(\frac{w}{d}\right) \quad \text{Formula 1}$$

$$1.773 \times e^{-\left(\frac{\theta-13.95}{22.95}\right)^2} + 1.234 \times e^{-\left(\frac{\theta+0.2208}{0.4677}\right)^2} \quad \text{Formula 2}$$

$$\frac{f(d) \times k}{LB^{0.5} \times \tan\theta} \quad \text{Formula 3}$$

$$f(d) = -0.1734 \times d^3 + 0.6648 \times d^2 + 0.6372 \times d + 0.9788 \quad \text{Formula 4}$$

wherein θ is a viewing angle, w is a width of the display information, d is a distance between a user and the display information, k falls within a range from 8.4 to 30.8, and LB is the background transmissive light luminance.

3. The transparent display system according to claim 2, wherein the computation module further determines whether a display information size of the display information falls within a range from 0.15 degrees to 2.25 degrees of the viewing angle, if the display information size is determined not falling within the range from 0.15 degrees to 2.25 degrees of the viewing angle, the display information size is optimized.

4. The transparent display system according to claim 1, wherein performing the luminance contrast optimization procedure comprises at least one of optimizing the display information luminance, optimizing a display information size, changing a location of the display information displayed on the display panel and optimizing the field luminance.

5. The transparent display system according to claim 1, wherein the data acquisition module is further adapted to capture user information, and the computation module further adjusts a threshold value range of the luminance contrast of the display information based on the user information.

6. An operation method of a transparent display system, comprising:

capturing, using a data acquisition module, a field luminance of a field where a transparent display is located and a display information luminance of display information, wherein the field luminance comprises a foreground reflective light luminance and a background transmissive light luminance;

determining, using a computational module, whether a luminance contrast of the display information falls within a range from a lower boundary to an upper boundary based on the captured field luminance and the display information luminance, wherein the luminance contrast of the display information equals to the field luminance plus the display information luminance and then divided by the field luminance;

if the luminance contrast of the display information is determined falling within the range from the lower boundary to the upper boundary, the display information being output; and if the luminance contrast of the display information is determined not falling within the range from the lower boundary to the upper boundary, a luminance contrast optimization procedure being performed.

7. The operation method of the transparent display system according to claim 6, wherein the lower boundary is defined by Formula 1 and Formula 2, and the upper boundary is defined by Formula 1, Formula 3, and Formula 4, $$\theta = \tan^{-1}\left(\frac{w}{d}\right) \quad \text{Formula 1}$$

$$1.773 \times e^{-\left(\frac{\theta-13.95}{22.95}\right)^2} + 1.234 \times e^{-\left(\frac{\theta+0.2208}{0.4677}\right)^2} \quad \text{Formula 2}$$

$$\frac{f(d) \times k}{LB^{0.5} \times \tan\theta} \quad \text{Formula 3}$$

$$f(d) = -0.1734 \times d^3 + 0.6648 \times d^2 + 0.6372 \times d + 0.9788 \quad \text{Formula 4}$$

wherein θ is a viewing angle, w is a width of the display information, d is a distance between a user and the display information, k falls within a range from 8.4 to 30.8, and LB is the background transmissive light luminance.

8. The operation method of the transparent display system according to claim 7, further comprising:

determining whether a display information size of the display information falls within a range from 0.15 degrees to 2.25 degrees of the viewing angle; and if the display information size is determined not falling within the range from 0.15 degrees to 2.25 degrees of the viewing angle, the display information size being optimized.

9. The operation method of the transparent display system according to claim 8, wherein if the luminance contrast of the display information is lower than the lower boundary and the display information size falls within the range from 0.15 degrees to 0.6 degrees of the viewing angle, then the luminance contrast optimization procedure comprises increasing the display information size.

10. The operation method of the transparent display system according to claim 8, wherein if the background transmissive light luminance is twice greater than the display information luminance, optimizing the field luminance comprises shielding a whole region or a partial region of a background image.

11. The operation method of the transparent display system according to claim 8, wherein if a luminance of a background image is greater than 600, optimizing the field luminance comprises shielding a high luminance region in the background image.

12. The operation method of the transparent display system according to claim 8, wherein if the field luminance is lower than a default value, optimizing the field luminance comprises enhancing a luminance of a whole region of a display panel.

13. The operation method of the transparent display system according to claim 8, wherein if the display information traverses a boundary between a high luminance region and a low luminance region of a background image, optimizing the field luminance comprises enhancing a luminance of the low luminance region in the background image.

14. The operation method of the transparent display system according to claim 6, wherein performing the luminance contrast optimization procedure comprises at least one of optimizing the display information luminance, optimizing a display information size, changing a location of the display information and optimizing the field luminance.

15. The operation method of the transparent display system according to claim 6, further comprising:

capturing user information; and adjusting a threshold value range of the luminance contrast of the display information based on the user information.

* * * * *